US011598551B2

(12) United States Patent
Dykhuis

(10) Patent No.: US 11,598,551 B2
(45) Date of Patent: Mar. 7, 2023

(54) AIR GRILLE FOR AN HVAC SYSTEM WITH A COLLAPSIBLE FILTER HOLDER

(71) Applicant: Cardinal IP Holding, LLC, Milwaukee, WI (US)

(72) Inventor: Thomas J. Dykhuis, Holland, MI (US)

(73) Assignee: Cardinal IP Holding, LLC, Glendale, WI (US)

( * ) Notice: Subject to any disclaimer, the term of this patent is extended or adjusted under 35 U.S.C. 154(b) by 192 days.

(21) Appl. No.: 16/915,638

(22) Filed: Jun. 29, 2020

(65) Prior Publication Data

US 2021/0404699 A1 Dec. 30, 2021

(51) Int. Cl.
*F24F 13/08* (2006.01)
*F24F 13/20* (2006.01)

(52) U.S. Cl.
CPC ..... *F24F 13/082* (2013.01); *F24F 13/085* (2013.01); *F24F 2013/207* (2013.01)

(58) Field of Classification Search
CPC ..... F24F 13/082; F24F 13/085; F24F 13/28
USPC ..... 454/184
See application file for complete search history.

(56) References Cited

U.S. PATENT DOCUMENTS

| | | | | |
|---|---|---|---|---|
| 7,537,632 | B2 | 5/2009 | Miller et al. | |
| 8,382,874 | B2 | 2/2013 | Greist et al. | |
| 8,979,965 | B2 | 3/2015 | Minaeeghainipour | |
| 2002/0022450 | A1* | 2/2002 | Berger | F24F 13/0272 454/290 |
| 2013/0143478 | A1* | 6/2013 | Arcos | H01H 33/08 454/184 |
| 2017/0182445 | A1 | 6/2017 | Zhang et al. | |
| 2017/0314812 | A1* | 11/2017 | Hurley | B01D 46/0005 |
| 2019/0212029 | A1* | 7/2019 | Kirk | B01D 46/10 |

* cited by examiner

*Primary Examiner* — Edelmira Bosques
*Assistant Examiner* — Michael James Giordano
(74) *Attorney, Agent, or Firm* — Dinsmore & Shohl LLP

(57) ABSTRACT

The present disclosure envisages an air grille. The air grille comprises a front face and a duct face end. The duct face end is in the opposite of the front face. A plurality of flaps are configured on the duct face end, wherein the flaps are capable of collapsing. During shipping the flaps are collapsed whereas before installation the flaps are uncollapsed to facilitate containment of an air filter. The air grille has first thickness when the flaps are collapsed and second thickness when the flaps are uncollapsed, wherein the first thickness is less than the second thickness.

10 Claims, 8 Drawing Sheets

AIR GRILLE FOR AN HVAC SYSTEM WITH A COLLAPSIBLE FILTER HOLDER

BACKGROUND

The present disclosure relates generally to an air grille and, more particularly, to an air grille for an air duct of a heating, ventilation, and air conditioning (HVAC) system.

A wide range of applications exist for HVAC systems. For example, residential, light commercial, commercial, and industrial systems are used to control temperatures and air quality in residences and buildings. HVAC systems include ducts that guide airflow. As an example, air return ducts remove air from a room and return the air to the HVAC system. Recycling the air through the air return duct maintains pressure within the building or residential space during operation of the HVAC system. The air removed from the room often includes airborne particulates, such as pollen, dust, and other airborne debris, that may damage the HVAC system. Accordingly, air grilles are positioned at an opening of the air return duct or a plenum positioned upstream of the air return duct to remove large airborne debris (e.g., a balloon) and conceal the air return duct. In certain HVAC systems, the air grille may include a filter frame housing a filter that removes the airborne particulates from the air before returning the air to an HVAC unit of the HVAC system. Air grille may also be used with different ducts and components of an HVAC system. Such air grilles are typically located on a wall, ceiling, or floor of a confined space. Therefore, the air grilles are generally visible to a person. It should be noted that air grilles may also be utilized in conjunction with other features, such as dampers, to provide products, such as registers for use in HVAC systems. Other air grilles may be employed in different systems to facilitate, guide, or manage flow.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In accordance with a first embodiment of the present disclosure, an air grill having a first face end and a duct face end is envisaged. The duct face end comprises a plurality of flaps that are capable of collapsing. The plurality of flaps are collapsed for shipping, wherein in the collapsed configuration the flaps are substantially coplanar. Alternatively, at least one of the plurality of flaps is uncollapsed during installation enabling the uncollapsed flap(s) to hold an air filter. A plurality of first fold lines is configured on the duct face end to facilitate the flaps to either collapse or uncollapse.

In accordance with a second embodiment of the present disclosure, an air grill for mounting over an opening of a duct of a forced air system is envisaged. The air grille comprises a plurality of flaps that are capable of collapsing and holding an air filter. The air grille comprises a front face having louvers configured thereon, wherein the plurality of flaps extend from rear of the front face. The flaps may be selectively uncollapsed to receive and hold the air filter. In an embodiment, the flaps are coplanar forming a quadrangular frame when collapsed.

In accordance with a third embodiment of the present disclosure, an air grille comprising a plurality of side wall portions and a plurality of panels extending from the side wall portions is envisaged. Each panel comprises a first fold line and a flap extending from the first fold line which is capable of collapsing. In an embodiment, one or more flaps define a channel for accommodating an air filter therein when uncollapsed. In another embodiment, one or more flaps when uncollapsed extend towards an operative rear of the air grille.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

The present disclosure is directed toward air grilles (also referred as "filter grilles") and, more particularly, air grille for use with air ducts of heating, ventilation, and air conditioning (HVAC) systems. Additionally, the air grille disclosed herein may be enabled to house a filter defined by a filter media and a frame circumscribing the filter media. The filter is utilized to remove air and airborne particulates from an enclosed space and return air to an HVAC unit of the HVAC system via the return air duct. The disclosed air grille holds the filter post shipping and during installation, and have a shipping density of ¼ as compared to the conventional filter grilles. Specifically, the thickness of the air grille of the present disclosure is reduced by 75 percent when flaps of the air grille are collapsed as compared to the thickness of the air grille with flaps uncollapsed. Therefore, minimizing the shipping density and reducing shipping/transportation cost. The air grille of the present disclosure is designed such that duct face end is manufactured flat, wherein the flaps are substantially coplanar when collapsed. Before installation or post shipping, an operator is required to uncollapse one or more flaps to the installed geometry.

It should be noted that while the discussion of present embodiments is generally provided in the context of air grilles for air return ducts, the disclosed air grille can also be used with other features, such as air supply ducts. Indeed, air grille in accordance with the present embodiments may be used with various ducts, which may include different types of channels and flow paths. Although, the present disclosure describes an air grille for simplicity, it is to be noted that the air grille may also be referred as a filter grille.

Figure 1:
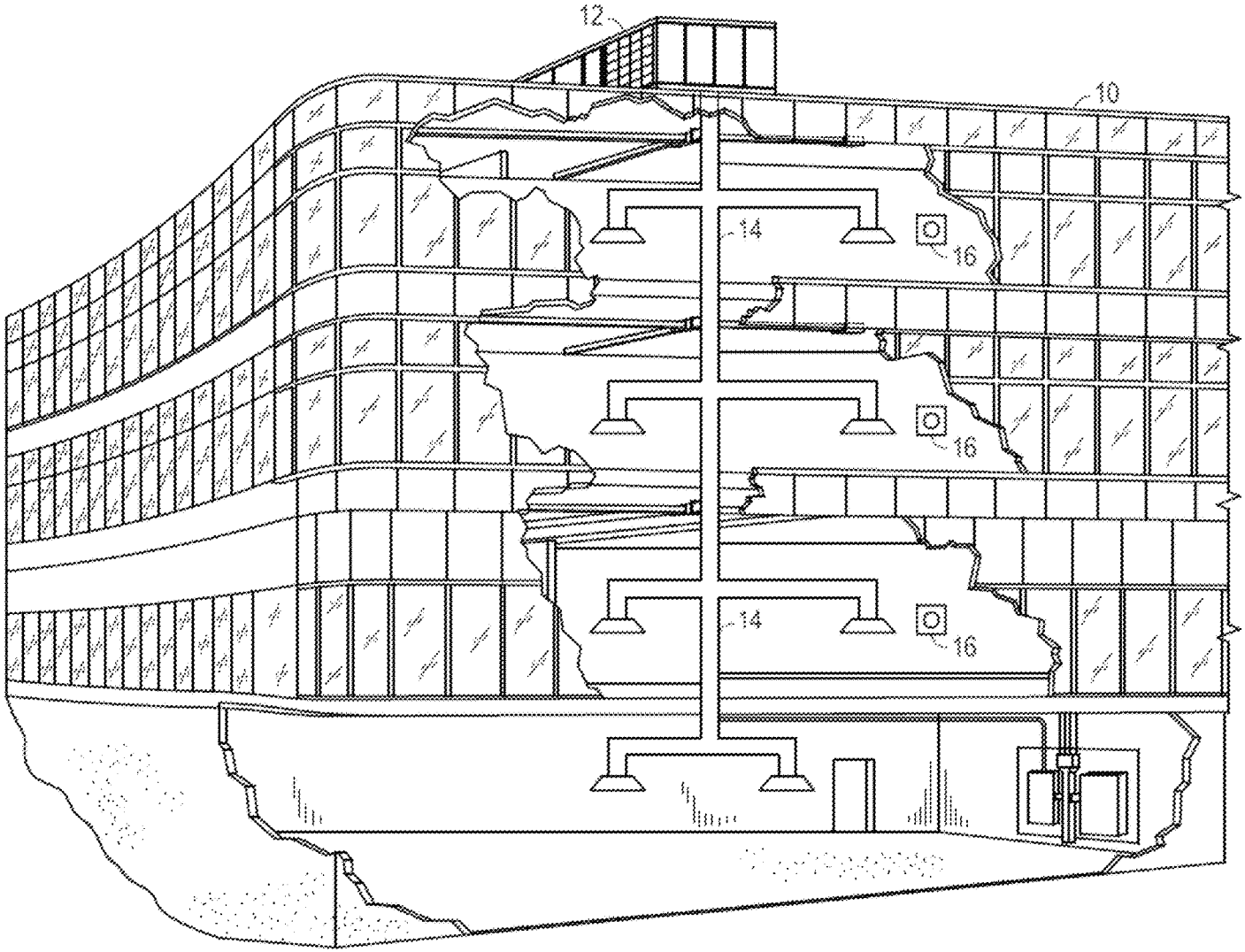
FIG. 1 is a perspective view a heating, ventilating, and air conditioning (HVAC) system for building environmental management, in accordance with embodiments described herein.

Turning now to the drawings, FIG. 1 illustrates a heating, ventilation, and air conditioning (HVAC) system for building environmental management that may employ one or more HVAC units and air grilles in accordance with present embodiments. In the illustrated embodiment, a building 10 is air conditioned by the HVAC system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
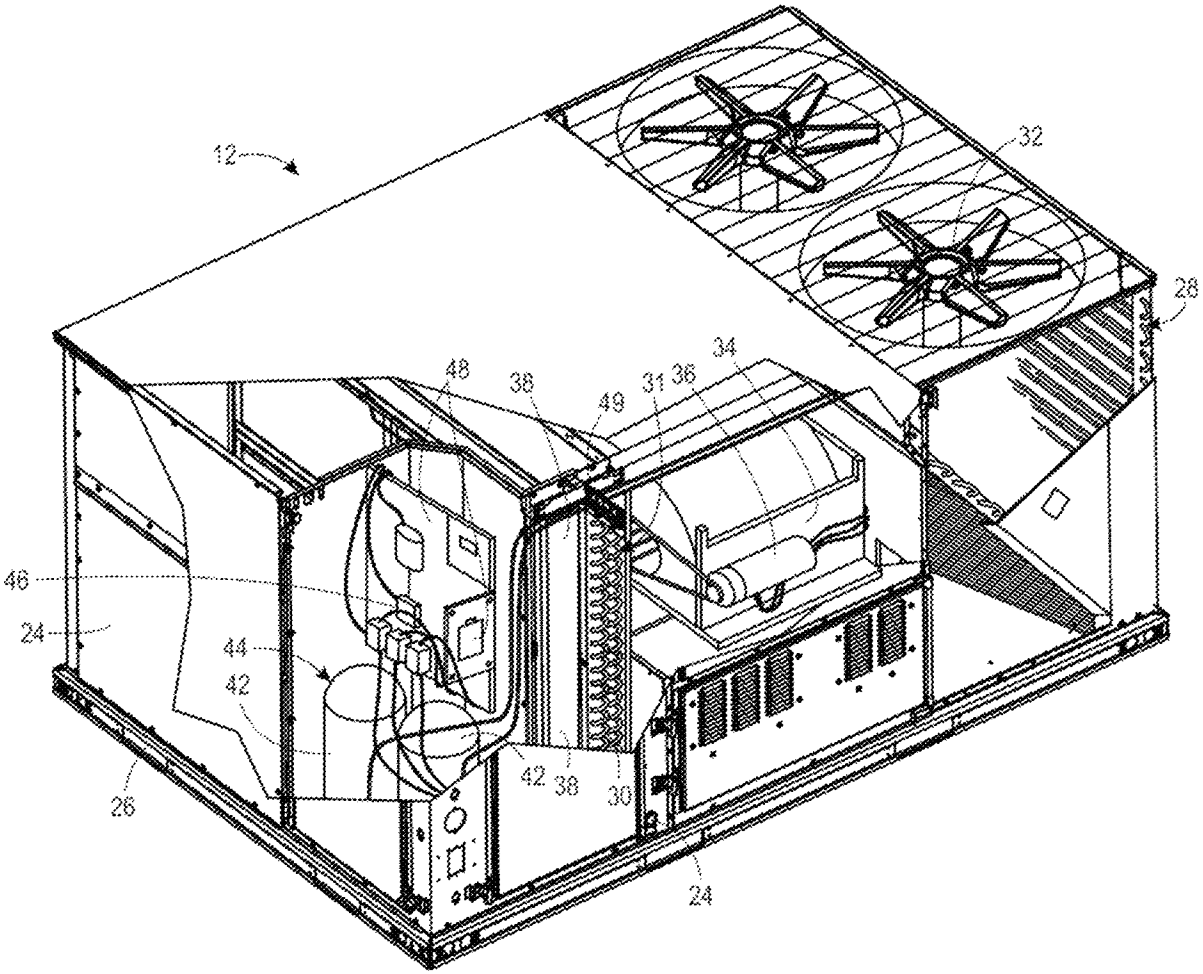
FIG. 2 is a perspective view of the packaged HVAC unit of the HVAC system of FIG. 1, in accordance with embodiments described herein.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heating, cooling with dehumidification, cooling with gas heating, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant through the heat exchangers 28 and 30. For example, the refrigerant may be R-410A. The tubes may be of various types, such as multichannel and/or microchannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
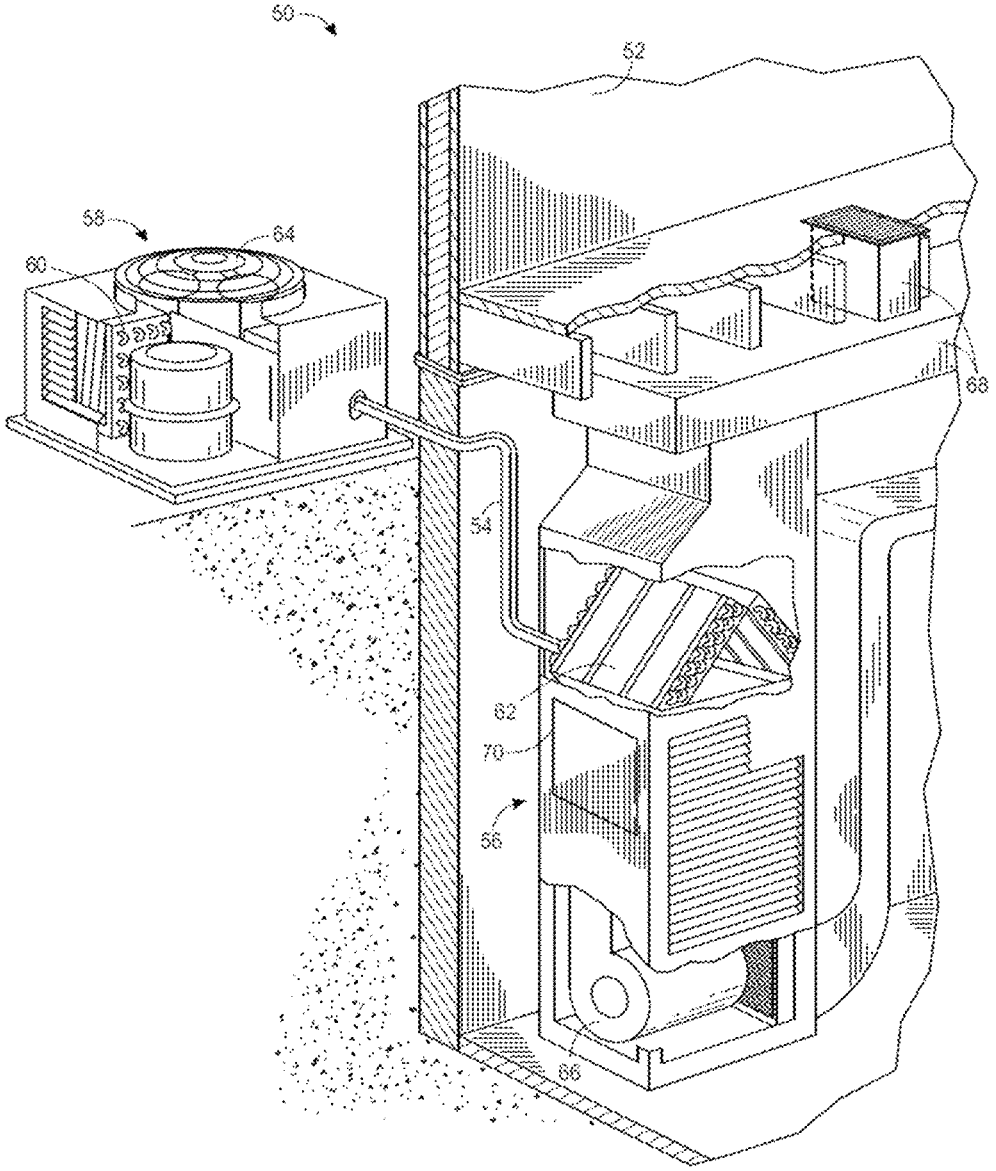
FIG. 3 is a perspective view of a residential HVAC system, in accordance with embodiments described herein.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
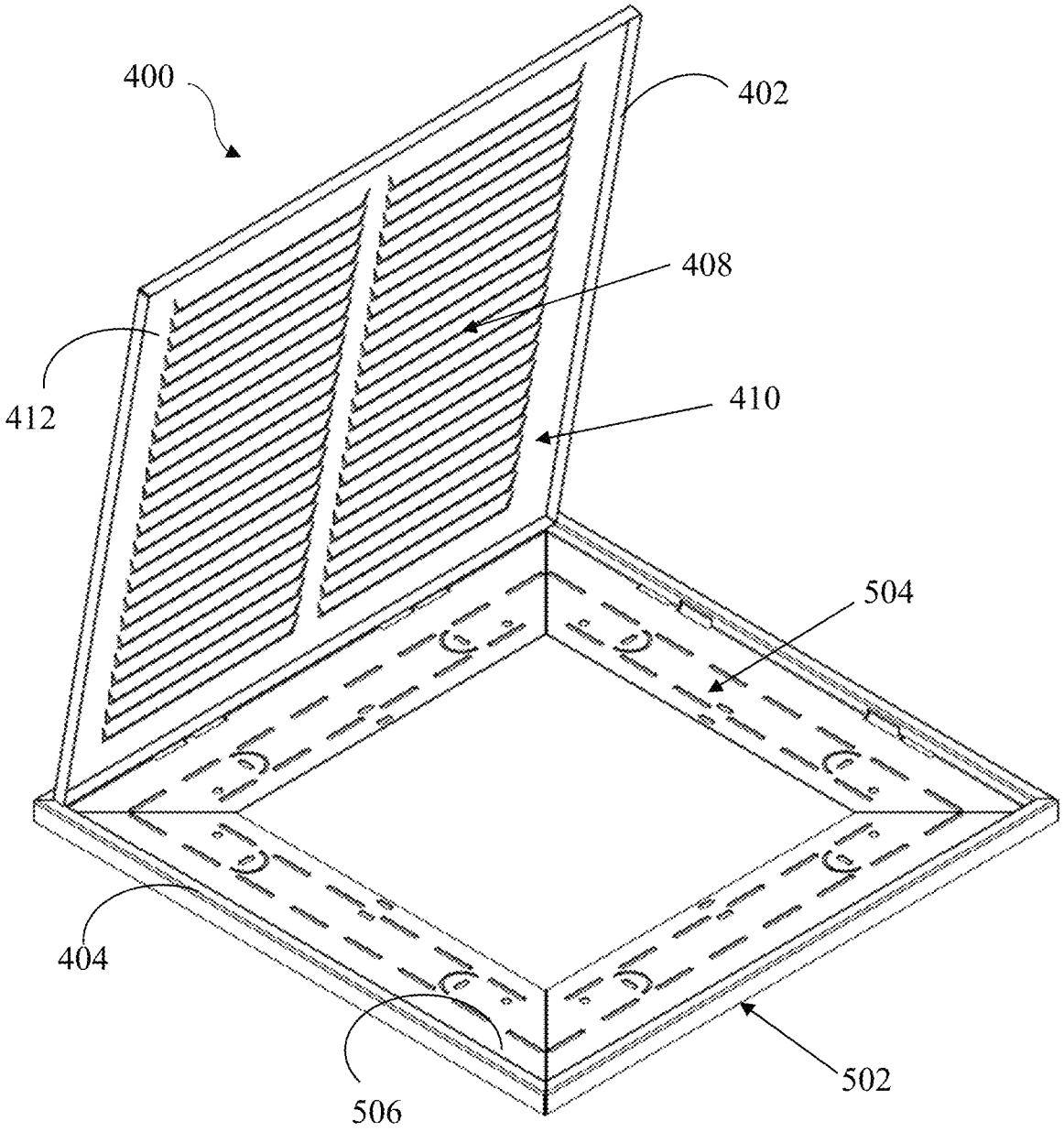
FIG. 4 is an isometric view of the air grille depicting front face and duct face end, according to some embodiments of the present disclosure.

FIGS. 4 to 8 illustrate an air grille 400 in accordance with some embodiments of the present disclosure. The air grille 400 is typically positioned over an open end of a duct, such as an air return duct, or a plenum upstream of the duct associated with any of the systems described above. In an embodiment, the air grille 400 is mounted over an opening of the duct of a forced air system. FIG. 4 illustrates an isometric view of the air grille 400 having a front face 402, depicting room side end face of the air grille 400, and a duct face end 404.

When positioned over the open end of the duct, the duct face end 404 of the air grille 400 is in fluid communication with one or more units of any of the aforementioned systems. In one embodiment, the air grille 400 operates to return air to the HVAC unit 12 via the air return duct of the HVAC system. Additionally, the air grille 400 conceals the air return duct, which improves the aesthetics of the room.

The air grille 400 comprises the front face 402 and the duct face end 404. In some embodiments, the front face 402 is pivotally coupled with the duct face end 404, wherein the front face 402 is enabled to be angularly displaced with respect to the duct face end 404 to define an opening for reception of an air filter 702 (best shown in FIG. 7). The air filter 702 of the present disclosure may be defined by a filter media 706 and a frame 704 circumscribing the filter media 706. In an embodiment, the filter media 706 is made from a spun fiberglass material or from pleated paper or cloth.

The air grille 400 of the present disclosure is enabled to securely hold the received air filter 702. In an embodiment, the front face 402 may be coupled with the duct face end 404 by one of a pin-rod, a hinge, swivel, a ball and a socket, and a pivot.

The front face 402 of the air grille 400 is provided with a plurality of louvers 408 configured thereon and a flange 410 circumscribing the louvers 408. In some embodiment, the louvers 408 may be bifurcated into multiple sets of louvers, wherein each set of louvers are configured in a spaced apart configuration. In an embodiment, the flange 410 extends at a distance 412 away from the louvers 408 to enable locking of the front face 402 with the duct face end 404. In one exemplary embodiment, the flange 410 extends at the distance 412 away from the louvers 408 to facilitate coupling of the air grille 400 to a wall, ceiling, or floor of a room. In another embodiment, the flange 410 extends at the distance 412 away from the louvers 408 to facilitate installation of the air grille 400 into a T-Bar lay in grid ceiling system. For example, once positioned over the opening of the air return duct, the air grille 400 may be secured onto a desired surface by inserting a coupling member into a receptacle (not specifically shown in the figures) of the flange 410. By way of non-limiting example, the coupling member may include a nail, a screw, a bolt, or any other suitable coupling member that can be used to secure the air grille 400 to the desired surface. In certain embodiments, the air grille 400 may be installed in a ceiling T-Bar grid system with no return air ductwork.

Typically, the louvers 408 are oriented at a non-perpendicular angle relative to a flange axis. It should be noted that the flange axis is generally orthogonal, to a flow path of air through the air grille 400.

In one implementation, the duct face end 404 comprises a plurality of side wall portions 502 and a plurality of panels 506. The panels 506 extend from the side wall portions 502. In an embodiment, the panels 506 extend from an operative lower end of the side wall portion 502. Each panel 506 extends from the side wall portion 502 towards a space defined within the air grille 400. In an embodiment, the air grille 400 has a square shaped profile or a rectangular shaped profile having four side wall portions 502. The side wall portions 502 define the outer periphery of the duct face end 404 or the air grille 400.

Figure 5:
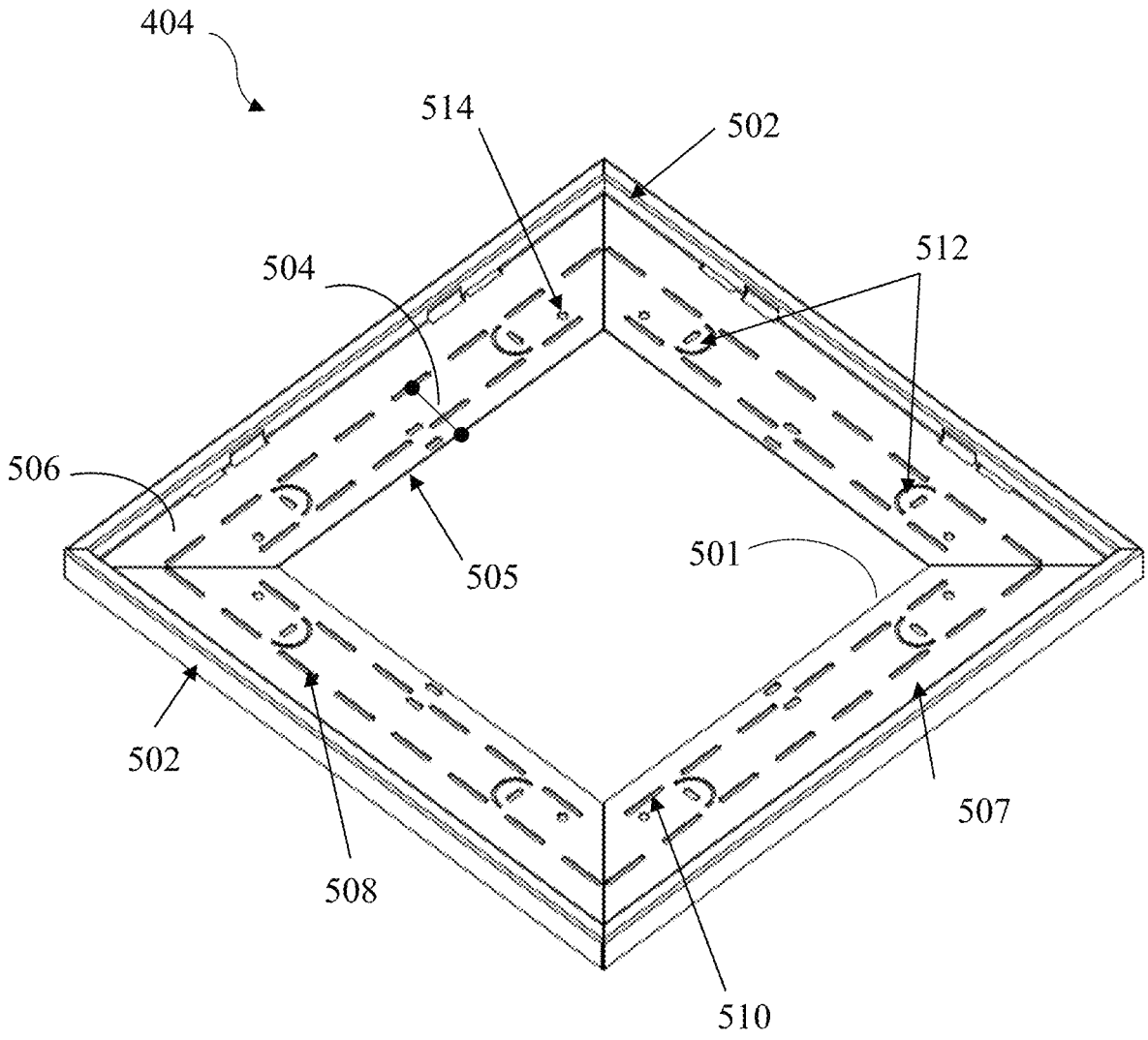
FIG. 5 is an isometric top view of a duct face end of the air grille of FIG. 4 depicting flaps when collapsed, in accordance with an embodiment of the present disclosure.

Each of the plurality of panels 506 are provided with a first fold line 508 and the portion of the panels 506 extending from the first fold line 508 is recognized as flaps 504, wherein the flaps 504 are collapsible. Typically, each of the plurality of flaps 504 comprises an edge (may also be referred as initiating edge) formed by the first fold line 508. FIG. 5 is an isometric top view of the duct face end 404 depicting flaps 504 in the collapsed configuration. The flaps 504 are enabled to be either collapsed 501 or uncollapsed 602 (best shown in FIG. 6) along the first fold lines 508. In an embodiment, the flaps 504 may be selectively collapsed 501 or uncollapsed 602 as per the requirement. Typically, the flaps 504 are collapsed 501 during transit/shipping and uncollapsed 602 post shipping and prior installation.

In the collapsed configuration 501, the portion of the panels 506 extending from or beyond the first fold line 508, i.e. the flap 504, is in-line with the portion of the panels 506 terminating at the first fold line 508. In one embodiment, the portion of the panels 506 terminating at the first fold line 508 is referred as a flat surface 507. Therefore, the panels 506 and/or flaps 504 are substantially coplanar when collapsed 501.

Figure 6:
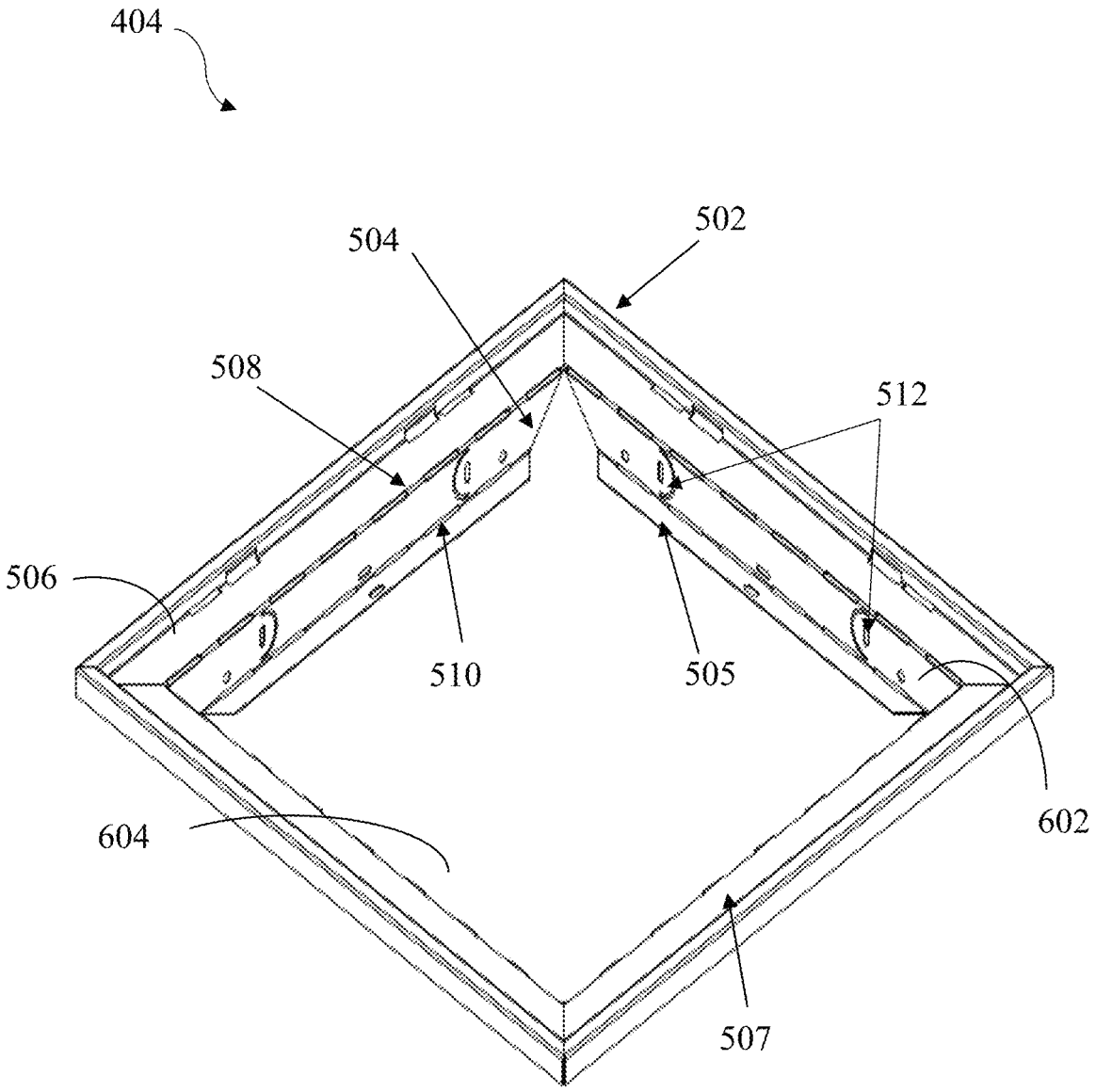
FIG. 6 is an isometric top view of the duct face end of the air grille of FIG. 4 depicting flaps when uncollapsed, in accordance with an embodiment of the present disclosure.
Figure 7:
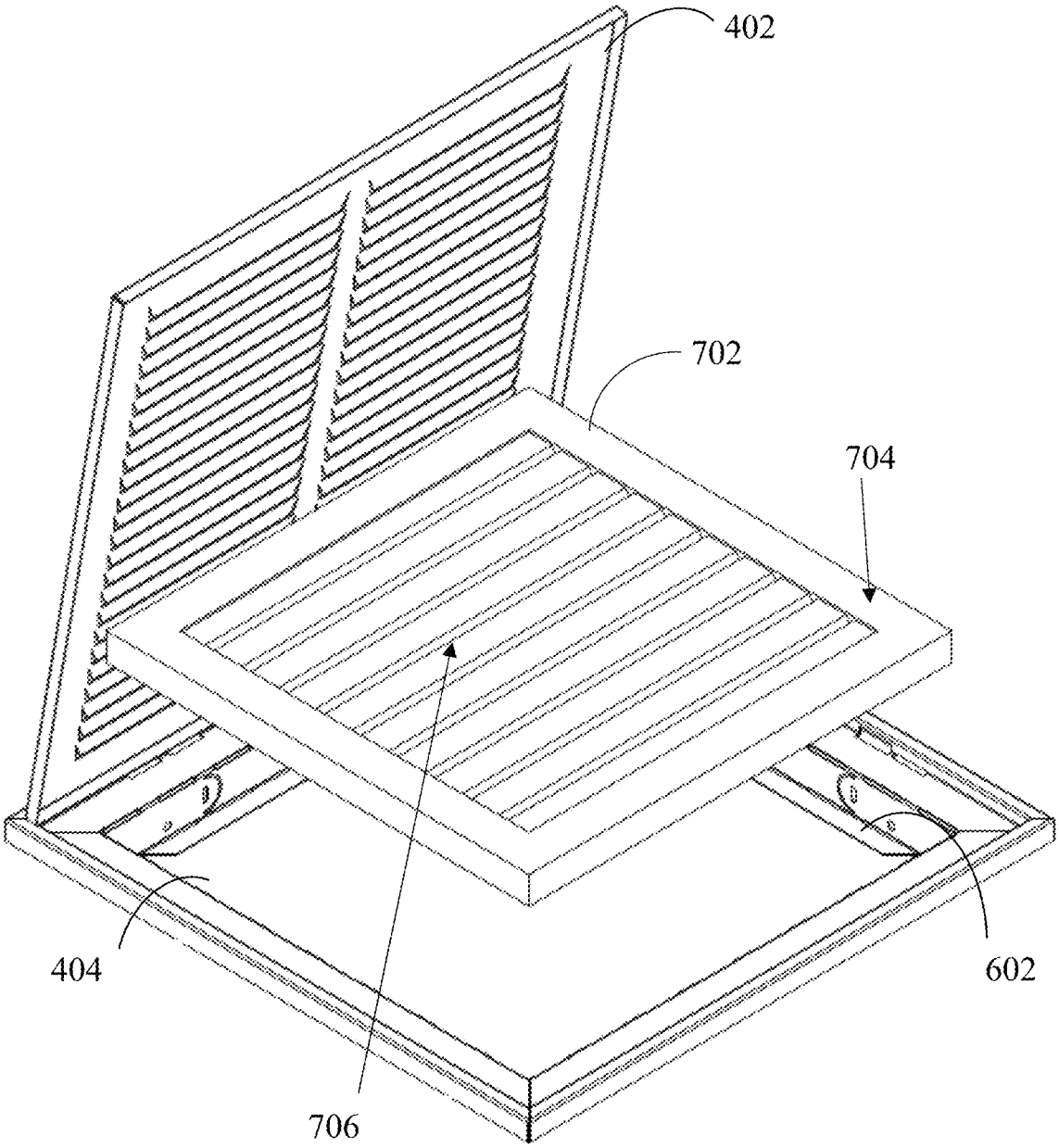
FIG. 7 is a schematic view of the air grille of FIG. 4 with flaps uncollapsed to accommodate an air filter.
Figure 8:
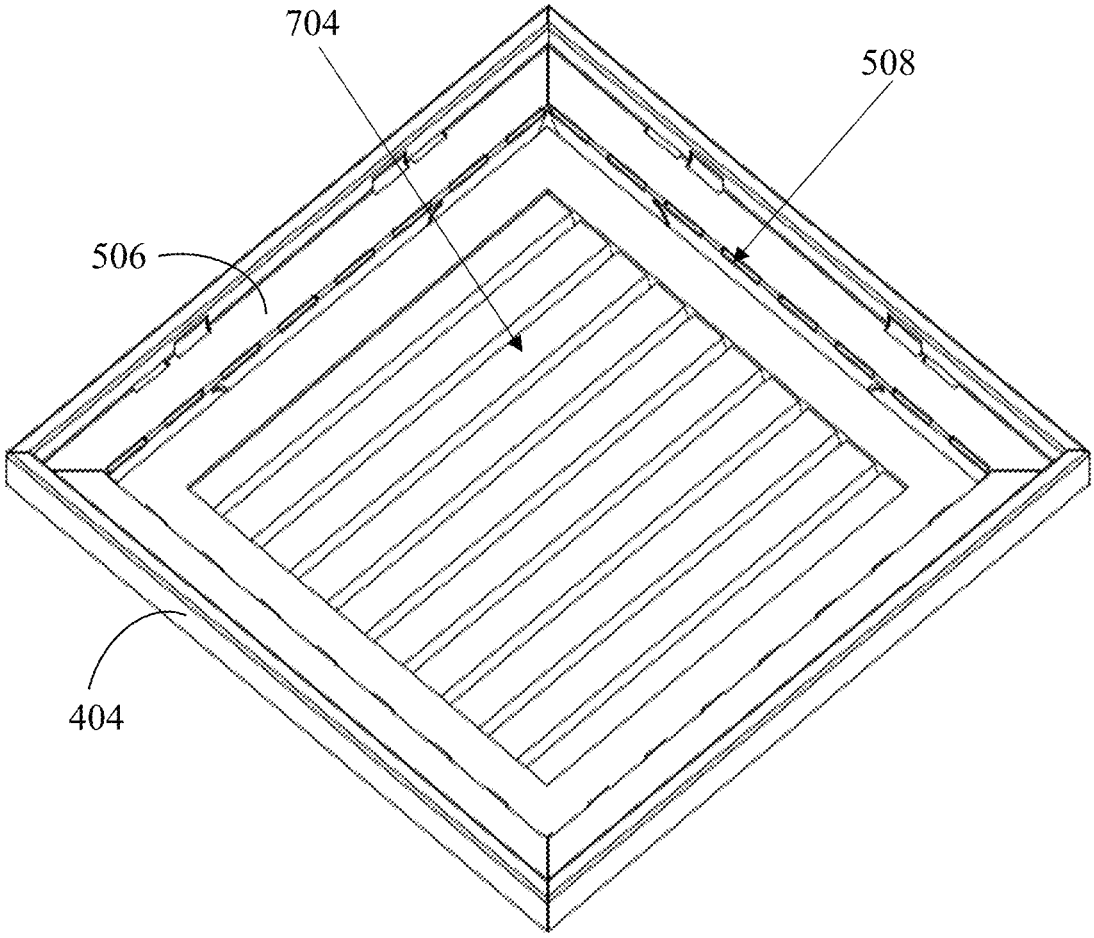
FIG. 8 is an isometric view of the duct face end of the air grille of FIG. 4 housing the air filter therein.

FIG. 6 depicts an isometric top view of the duct face end 404 depicting flaps 504 when uncollapsed 602. Further, one or more flaps 504 when uncollapsed 602 is enabled to define a channel 604 for placement of the air filter 702 therein. For example, the air from the room may flow into the return air duct or plenum of the HVAC system via the air filter 702 positioned within the channel 604 defined by one or more uncollapsed flaps 504. The one or more flaps 504 when uncollapsed 602 extend away from the flange 410 towards the duct/plenum. Specifically, when uncollapsed 602, the operative free end 505 of the one or more flaps 504 extend away from the flange 410 towards the duct/plenum. In an embodiment, the one or more flaps 504 is oriented orthogonal to the flange 410, when uncollapsed 602. In another embodiment, the one or more flaps 504 may be uncollapsed towards a non-perpendicular angle with respect to the flange 410. Specifically, the angular displacement of the one or more flaps 504 is directly dependent on the dimensions of the air filter 702 to be contained within the air grille 400. In an exemplary embodiment, if the dimensions of the air filter 702 to be contained within the air grille 400 is less than the dimensions of the channel 604 defined when the flaps 504 that are uncollapsed and oriented orthogonal to the flange 410, then the one or more flaps 504 may be uncollapsed at an angle less than 90 degrees.

Alternatively, in accordance with an embodiment of the present disclosure, one or more flaps 504 is provided with one or more filter retainers 512. The filter retainers 512 are configured to restrict lateral movement of the air filter 702 contained within the air grille 400. In one embodiment, the filter retainers 512 are enabled to be angularly displaced towards the air filter 702 to accommodate and secure the air filter 702 of varied dimensions within the channel 604. In another embodiment, the filter retainers 512 may be configured as displaceable protruding members that are enabled to be selectively displaced towards the air filter 702.

In certain embodiments, one or more filter retainers 512 include a deformable tab or cantilever that may be moved from a first position that is parallel to a corresponding feature of the flap 504 to a second position that is substantially orthogonal to a corresponding feature of the flap 504. In the second position, the deformable tab abuts against the frame 704 of the air filter 702 to secure the air filter 702 within the channel 604.

In an embodiment, the first fold lines 508 are configured on the panels 506 and are positioned proximal to the side wall portions 502. In another embodiment, each of the first fold lines 508 are equidistance from the side wall portions 502. In one non-limiting embodiment, the first fold lines 508 configured on the panels 506 have either a square shaped profile or a rectangular shaped profile.

In accordance with an embodiment of the present disclosure, a second fold line 510 is configured on each of the flaps 504. The second fold line 510 is configured proximal to the operative free end 505 (also referred as terminating end) of the flaps 504, thereby enabling the free end portion that extends from the second fold lines 510 to be angularly displaced along the second fold lines 510. In an embodiment, the free end portion of the flaps 504 is angularly displaced when the flaps 504 are uncollapsed 602, thereby enabling the free end portion of the flaps 504 to restrict the movement of the air filter 702 when contained within the air grille 400. Since while in operation the air flow via the channel 604 may drag the air filter 702 towards the duct. The angularly displaced free end portion of one or more flaps 504, when uncollapsed 602, abuts a side of the air filter 702. In an embodiment, the angularly displaced free end portion of the flaps 504 abuts the air filter 702 from all sides. Typically, the free end portion of the flaps 504 are angularly displaced to align in parallel with the flange 410. Alternatively, the free end portion of the flaps 504 are angularly displaced to align substantially perpendicular with the portion of flap 504 extending between the first fold line 508 and the second fold line 510.

In an embodiment, the first fold lines 508 and the second fold lines 510 are defined by alternate bridges and slits. In another embodiment, the first fold lines 508 and the second fold lines 510 are defined by any one of slots, slits, holes, hollow sections, scored sections, sliced sections, and cut sections.

In accordance with an embodiment of the present disclosure, a plurality of through-holes 514 are configured on the panels 506 to enable reception of fasteners for securing the air grille 400 with walls of the duct. Preferably, the through-holes 514 are configured on the flaps 504 of the panels 506 enabling the through-holes 514 to be aligned with complementary slots/holes configured on the walls of the duct. For example, one or more flaps 504 when uncollapsed 602 and the air grille 400 is positioned over the open end of the duct, the air grille 400 may be secured onto a desired surface by inserting a coupling member into the through-holes 514 of the flaps 504. By way of non-limiting example, the coupling member may include a nail, screw, bolt, or any other suitable coupling member that can be used to secure the air grille 400 to the desired surface. Typically, at least one slot through-holes may be provided on each of the flaps 504.

In one configuration, the duct face end 404 of the air grille 400 comprises four side panels 506 having first fold lines 508. Each of the four side panels 506 is defined by the flat surface 507 and the flap 504, wherein the flat surface 507 extends from the side wall portions 502 and terminates at the first fold line 508. Typically, the flat surface 507 of the panels 506 abuts the opening of the duct while installation of the air grille 400. Additionally, the flange 410 of the front face 402 abuts the flat surface 507 of the panels 506 when in closed positioned.

In one non-limiting embodiment, the panels 506 may be defined by the flaps 504, wherein the flaps 504 may extend from the side wall portions 502. In this embodiment, the first fold lines 508 may be configured on bottom edges of the side wall portion 502.

The first fold lines 508 on each of the panels 506 demarcates the flat surface 507 and defines the portion of the panel extending from the first fold lines 508 as the flap 504. During shipping, the flaps 504 are collapsed 501, i.e., the flaps 504 are aligned in-line with the flat surface 507 forming a quadrangular frame, wherein the adjacent flaps 504 abuts. The quadrangular frame comprises substantially coplanar flaps 504/panels 506. The flaps 504, in collapsed configuration 501, reduces the overall thickness of the air grille 400 by up to 75 percent as compared to the flaps 504 when in uncollapsed configuration. Prior to installation, one or more flaps 504 are uncollapsed along the first fold lines 508, i.e., the flaps 504 extend towards the duct of the HVAC system. Additionally, the free end portion of the uncollapsed flaps 504 is angularly displaced along the second fold lines 510 configured proximal to the free end 505 of the flaps 504. The free end portion of the flaps 504 curbs the movement of the air filter 702 while the HVAC system is operational, thereby preventing the filter from escaping the air grille 400 and entering the duct.

In one embodiment, the flaps 504 are enabled to circumscribe the air filter 702 when uncollapsed.

In accordance with one non-limiting embodiment of the present disclosure, the duct face end 404, of the air grille 400, may comprise flour flaps 504 extending from the side wall portion 502, wherein each flap extends from an associated side wall portion 502. In an embodiment, the side wall portions 502 have L-shaped profile which abuts with an opening of the duct for installation and the flaps 504 when uncollapsed are aligned substantially parallel with the walls of the duct. These flaps 504 are substantially coplanar in collapsed configuration 501, and are enabled to hold the air filter 702 when uncollapsed 602.

In some embodiments, one or more fold lines is configured on the duct face end 404. The plurality of flaps 504 extend from first fold lines 508 configured on the duct face end 404, and are either collapsed 501 or uncollapsed 602 along the first fold lines 508. The first fold lines 508 are configured on the duct face end 404 in between the flaps 504 and the L-shaped side wall portions 502. In one embodiment, the first fold lines 508 define the edge of the flaps 504. In an embodiment, the side wall portions 502 may resemble any other suitable shape. Further, second fold lines 510 are configured on the duct face end 404, i.e., specifically on the flaps 504 and proximal to the free ends of the flap 504. The portion of the flap 504 extending from the second fold line 510 is enabled to be angularly displaced along the second fold line 510 to curb the movement of the air filter 702 contained within the air grille 400.

In accordance with an embodiment of the present disclosure, the air filter 702 is housed within the air grille 400 from an operative front of the air grille, i.e. by either detaching the front face 402 or angularly displacing the front face 402 to define an opening or passage for receiving and removing the air filter 702. In one embodiment, the front face 402 is pivotally coupled with one of the side wall portions 502. In another embodiment, the front face 402 is removably coupled with the duct face end 404 or the side wall portions 502.

In accordance with an embodiment of the present disclosure, the flaps 504 may be removably coupled to the side wall portions 502. In accordance with another embodiment of the present disclosure, the flaps 504 may be connected to the side wall portions 502 by one of a pin-rod, a hinge, a swivel, a ball and socket, and a pivot. The flaps 504 are enabled to be collapsed and uncollapsed by means of the one of pin-rod, hinge, swivel, ball and socket, and pivot. In one embodiment, the air grille 400 is provided with a locking mechanism to retain the position of the flaps 504 in either of the collapsed or uncollapsed configuration. In yet another embodiment of the present disclosure, the flaps 504 may be integral with the side wall portion 502.

In accordance with still another implementation of the present disclosure, an air grille 400 comprises a front face 402 and a plurality of flaps 504. The front face 402 comprises louvers 408 and flanges 410, wherein the flanges 410 circumscribe the louvers 408. The plurality of flaps 504 is connected to the front face 402 preferably on the rear surface of the front face 402. In an embodiment, the flaps 504 may be connected on the terminating edges of the flanges 410. The plurality of flaps 504 is capable of collapsing. The flaps 504 are configured to collapse 501 and uncollapse 602. Particularly, the flaps 504 are collapsed 501 while shipping/transportation, and are uncollapsed 602 while being installed. In one non-limiting embodiment, the duct face end may be defined by the collapsible flaps 504.

In collapsed configuration 501, the flaps 504 are substantially coplanar and substantially parallel with the flanges 410. In an embodiment, the flaps 504 when coplanar resembles quadrangular frame. Typically, in collapsed configuration 501, the flaps 504 tend to partially cover the louvers 408 from the operative rear of the air grille 400. In an embodiment, the first fold line 508 is configured on each side of the air grille 400, wherein the flaps 504 extend from the first fold lines and are enabled to be collapsed and uncollapsed by angularly displacing along the first fold lines.

In another embodiment, the flaps 504 may be removably coupled to the front face 402 of the air grille 400. In one embodiment, the flaps 504 may be attached by means of any one of a pin-rod, a hinge, swivel, a ball and a socket, and a pivot. In still another embodiment, the flaps 504 may be integral.

The flaps 504 in uncollapsed configuration 602 are aligned parallel with the walls of the duct. The flaps 504 when un-collapsed are placed within the opening of the duct wherein, the flaps 504 are securely connected with the walls of the duct by means of fasteners. The outer surface of the flaps 504 adjoin with the walls of the duct, wherein the inner surface of the flaps is enabled to securely hold the air filter 702.

In yet another embodiment of the present disclosure, one or more flaps 504 when collapsed may remain substantially coplanar and substantially parallel with the flanges 410. In collapsed configuration the flaps 504 may extend towards a space defined within the air grille 400, wherein the flaps 504 may partially overlap and partially cover the louvers 408. Additionally, the flaps 504 may be categorized as a first set of flaps and a second set of flaps. Each side of the air grille 400 may be provided with at least two flaps, wherein one of the two flaps may be a part of the first set of flaps and another flap may be a part of the second set of flaps. In uncollapsed configuration 602, the first set of flaps may be uncollapsed to align partially perpendicular with the flanges 410 while extending towards the duct and the second set of flaps may be uncollapsed to an angle in the range of 150 degrees to 180 degrees. It is to be noted that the second set of flaps are required to abut the wall of the enclosed space to facilitate mounting of the air grille 400 over an opening of the duct.

The air grille 400 of the present disclosure has first thickness when the flaps 504 are collapsed and has a second thickness when the flaps 504 are uncollapsed, wherein the first thickness is less than the second thickness. Thereby, reducing the shipping density and shipping cost. The air grille's geometry has been redefined so that when packaged for transport has a slim structure which reduces shipping density to around ¼th of the convention air/filter grilles being produced.

The main features which reduces the shipping density is the modification in the filter grille holder or the duct face end of the air grille which while packaging is produced flat but have a stamped/pressed line which is defined by some intermittent sheet cuts or lines. This line later acts as the fold lines for the installer to collapse/uncollapse the flaps appropriately and install at require space or frame.

In some embodiments, the air grille 400 of the present disclosure is made of a sheet metal.

In one embodiment, the air grille 400 may be a return air duct grille.

In ambit of the present disclosure, the air grille may be a filter grille or a filter register grille employed in HVAC systems.

CONFIGURATION OF EXEMPLARY EMBODIMENTS

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

What is claimed is:

1. An air grille, comprising:

a front face; and a duct face end comprising a plurality of flaps capable of collapsing, each flap of the plurality of flaps includes a first fixed portion, a second foldable portion joined to the first fixed portion at a first fold line, and a third foldable portion joined to the second foldable portion at a second fold line, the first fixed portion being parallel to the third foldable portion when in an uncollapsed configuration, and the second foldable portion being perpendicular to the first fixed portion and the third foldable portion when in the uncollapsed configuration, wherein at least one of the plurality of flaps is provided with one or more filter retainers provided on the second foldable portion and configured to restrict a lateral movement of an air filter.

2. The air grille of claim 1, wherein each of the plurality of flaps comprises an edge formed by the first fold line.

3. The air grille of claim 1, wherein the plurality of flaps are substantially coplanar in a collapsed configuration.

4. The air grille of claim 2, wherein at least one of the plurality of flaps positionable into the uncollapsed configuration to hold the air filter.

5. The air grille of claim 4, wherein at least one of the plurality of flaps comprises an operative free end portion defined by the third foldable portion to be angularly displaced along the second fold line to restrict movement of the air filter.

6. The air grille of claim 1, wherein the front face is pivotally coupled to the duct face end.

7. The air grille of claim 2, wherein the first fold line comprises alternate bridges and slits.

8. The air grille of claim 1, wherein the plurality of flaps are removably coupled to the duct face end.

9. The air grille of claim 1, wherein the plurality of flaps are integral to the duct face end.

10. The air grille of claim 1, wherein the plurality of flaps are coupled to the duct face end by one of a pin-rod, a hinge, a swivel, a ball and a socket, and a pivot.

* * * * *